US005291939A

United States Patent [19]

Hensley et al.

[11] Patent Number: 5,291,939

[45] Date of Patent: Mar. 8, 1994

[54] START-UP METHOD AND APPARATUS FOR CONTINUOUS CASTING OF METAL INTO STRIP PRODUCT

[75] Inventors: John A. Hensley; James L. Stone; James C. Key; George A. Sloan, all of Garland County, Ark.

[73] Assignee: Reynolds Metals Company, Richmond, Va.

[21] Appl. No.: 979,105

[22] Filed: Nov. 23, 1992

[51] Int. Cl.[5] ..... B22D 11/06; B22D 11/08

[52] U.S. Cl. ..... 164/479; 164/483; 164/429; 164/473

[58] Field of Search ..... 164/483, 473, 463, 423, 164/429, 479

[56] References Cited

U.S. PATENT DOCUMENTS

| | | | |
|---|---|---|---|
| 3,305,902 | 2/1967 | Bjorksten . | |
| 3,522,836 | 8/1970 | King | 164/463 |
| 3,819,365 | 6/1974 | McCaulay et al. . | |
| 3,836,360 | 9/1974 | Bray . | |
| 3,871,870 | 3/1975 | Nemoto et al. . | |
| 4,010,876 | 3/1977 | Steinemann . | |
| 4,040,468 | 8/1977 | Nieman . | |
| 4,590,988 | 5/1986 | Fukuoka et al. | 164/463 |
| 4,828,012 | 5/1989 | Honeycutt, III et al. . | |
| 4,896,715 | 1/1990 | Honeycutt . | |
| 4,934,443 | 6/1990 | Honeycutt, III et al. . | |
| 4,940,077 | 7/1990 | Honeycut, III et al. . | |
| 4,945,974 | 8/1990 | Honeycutt, III . | |
| 4,955,429 | 9/1990 | Honeycutt, III et al. . | |

FOREIGN PATENT DOCUMENTS

| | | | |
|---|---|---|---|
| 0127578 | 12/1984 | European Pat. Off. . | |
| 59-42161 | 3/1984 | Japan | 164/463 |
| 61-16219 | 4/1986 | Japan | 164/463 |
| 63-24250 | 10/1988 | Japan . | |

*Primary Examiner*—Kuang Y. Lin
*Attorney, Agent, or Firm*—Robert C. Lyne, Jr.

[57] ABSTRACT

A start-up method and apparatus for continuous casting of molten metal into a cast strip product includes initially casting a start-up alloy having sufficient strength, flexibility and casting surface release properties to achieve steady state casting conditions. A target alloy follows the start-up alloy being cast to produce a cast strip product of the target alloy composition. A start-up alloying vessel is disposed between the source of the target alloy and the casting apparatus to facilitate introduction of a start-up alloy into the casting process or formulation of a particular start-up alloy for initiation of the continuous casting operation.

10 Claims, 3 Drawing Sheets

START-UP METHOD AND APPARATUS FOR CONTINUOUS CASTING OF METAL INTO STRIP PRODUCT

FIELD OF THE INVENTION

This invention relates to the start-up of continuous casting of molten metal into strip product, and in particular, providing a start-up alloy in an intermediate alloying vessel to initiate and achieve steady state continuous casting conditions prior to continuous casting of a selected metal alloy.

BACKGROUND ART

In the prior art, it is known to produce aluminum in coil form from a continuous casting apparatus wherein molten aluminum is delivered from a tundish and cast in the form of a metal sheet or strip and rolled into a coil on a coiler. Generally, in this process, molten aluminum is deposited on a moving chill surface from a tundish having an open outlet. An inlet is provided for the flow of molten metal into the tundish from a source of molten metal. The direct casting of the molten aluminum metal onto a chill wheel, preferably a grooved chill wheel, produces a cast aluminum product at a rapid rate. The aluminum cast strip is wound on a coiler in heated form, generally at a temperature in the range of about 400°-1000° F.

Drag casting apparatus and methods of this type are described, for example, in U.S. Pat. Nos. 4,828,012, 4,896,715, 4,934,443, 4,945,974, 4,940,077 and 4,955,429. The disclosures of these patents are hereby specifically incorporated by reference with respect to the method and apparatus for the production of aluminum strip and coil from molten aluminum or aluminum alloys.

With reference now to FIG. 1, a continuous casting apparatus is illustrated which is typical of prior art continuous casting apparatus using a driven chill surface. The continuous casting apparatus is generally designated by the reference numeral 10 and is seen to include a tundish 1 positioned adjacent a driven chill surface 3. The chill surface 3 comprises the external cylindrical surface of a casting wheel 5. The casting wheel 5 is internally cooled with circulating water or other conventional cooling fluids to extract heat through the chill surface 3 so as to solidify molten metal 7 exiting the tundish 1. A rotary brush 18 contacts the chill surface 3 to remove debris and other impurities prior to casting.

The casting wheel 5 is supported by journal bearings 9 for rotation about a fixed horizontal axis. The journal bearings 9 are supported on the supporting frame 11 which supports both the bearings and the tundish 1. The casting wheel may be driven by a suitable drive means such as a variable speed motor and reduction gear mechanism, not shown, and a drive chain or belt 13 engaging the casting wheel 5.

After the molten metal 7 contacts the chill surface 3 and is solidified as a strip 15, a coiling apparatus 17 accumulates the strip in coil form for further processing. The coiling apparatus may include rollers 23 to guide the cast strip to the coiler.

The continuous casting apparatus 10 may also include a burner 19 to selectively apply heat to the chill surface at a location beneath the tundish 1. In addition, a top roll 21 may be provided which is uncooled or heated, the top roll being mounted for rotation in contact with the molten metal prior to complete solidification of the strip.

However, these types of melt drag casting apparatus present difficulties in casting certain types of alloys. For example, at casting onset, the solidified head of the strip being cast does not release from the casting wheel. Consequently, the cast strip will wrap around the wheel, burning the brushes 18 and damaging the tundish 1. On the other hand, if the cast strip releases too quickly it can become entangled in the cast strip framework or other cast strip components.

Besides alloys having unacceptable release characteristics as described above, certain alloys lack the required physical strength characteristics for start-up conditions. During casting start-up, an alloy must have sufficient stiffness to feed through the strip handling equipment such as the guide rolls 23 located between the casting wheel 5 and the coiler 17. The cast alloy strip must also have sufficient tensile strength so that it is not pulled apart by the feed rolls when wrapping around the coiler 17. In combination with the required strength, the alloy cast strip must also possess sufficient flexibility to take gentle bends and direction changes without breaking.

Highly alloyed materials such as an AA aluminum alloy 5182 exhibit brittleness and high strength which make it difficult to begin casting. On the other hand, high purity aluminum alloys such as AA 1235 do not have sufficient strength to travel from the casting wheel through the material handling components to the coiler 17.

In view of the deficiencies in prior art melt drag casting apparatus, a need has developed to improve the continuous casting start-up sequence so as to successfully continuously cast these types of difficult-to-cast alloys.

In response to this need, the present invention provides a start-up alloying vessel in combination with a melt drag continuous casting apparatus. The start-up alloying vessel permits start-up continuous casting with an alloying composition having the necessary strength and release characteristics to establish steady state casting conditions. Once casting equilibrium is achieved, an alloy composition exhibiting characteristics making it difficult to initiate continuous casting is merged with the start-up alloying composition to produce a cast strip product of the desired composition.

In the prior art, various casting apparatus have been proposed which include an intermediate tundish disposed between a molten metal vessel and a casting surface or mold. In U.S. Pat. No. 3,836,360 to Bray, a launder is disposed between a furnace and a casting mold. A dilute master alloy as a pre-heated wire is fed into the launder while a pure molten copper enters the launder from a furnace. The alloying wire is pre-heated using an electrical circuit prior to submersion into the molten metal in the launder.

U.S. Pat. No. 3,871,870 to Nemoto et al. also discloses the use of an intermediate vessel disposed between a ladle and a mold for alloying purposes. In this patent, rare earth metals are added into the liquid steel in the intermediate vessel. Adding the rare earth elements in the intermediate vessel facilitates desulphurization of the liquid steel.

U.S. Pat. No. 4,010,876 to Steinemann discloses an arrangement for the delivery of predetermined amounts of molten metal from a sealed and heated storage vessel. The arrangement includes an intermediate vessel which permits measurement of the molten charge within the vessel. Inoculation or seeding agents may be added to the molten metal in the intermediate vessel.

U.S. Pat. No. 3,819,365 to McCaulay et al. provides a reaction chamber separate from the casting mold. The reaction chamber is used to add a nodularising agent to the untreated molten metal prior to casting. In U.S. Pat. No. 4,040,468 to Nieman, a wire of added material is inserted into a mixing chamber prior to a casting cavity. The mixing chamber has a semi-circular configuration to enhance mixing action between the wire additive and the molten metal.

U.S. Pat. No. 3,305,902 to Bjorksten uses an intermediate vessel in a casting apparatus to facilitate foaming of the metal. During casting, the molten metal is poured into an intermediate vessel prior to casting into the casting metal. A foaming agent is supplied to the intermediate vessel to foam the molten metal prior to final casting.

The prior art also discloses methods and apparatus concerned with continuous casting start-up. In European Patent Application Number 0127 578 to Buxmann et al., a casting nozzle in a twin-belt continuous casting machine is pre-heated by first casting with molten aluminum followed by casting with grey cast iron. The nozzle is then sufficiently preheated for casting steel. In Japanese Patent Number 63-242450, a method for continuously casting metal strip using two rotating cooling rolls is disclosed which shortens the time from casting start to steady state casting. At first, the tip of a dummy bar for drawing the continuously cast strip is inserted into the gap between the two rotating cooling rolls. An easy melting metal material is added adjacent to the dummy bar. The metal material is easily melted by holding heat of the molten metal as raw material is successively poured from the pouring basin. After casting, the dummy bar containing the easy melting metal is removed.

However, none of the prior art discussed above addresses the problems associated with melt drag casting of metal strip, in particular, aluminum alloys having physical properties causing problems in the start-up of melt drag casting. Further, the prior art does not recognize modifying a select amount of an alloy composition to be cast so as to initiate continuous casting and achieve steady state casting prior to onset of a difficult-to-cast alloy composition.

SUMMARY OF THE INVENTION

It is accordingly one object of the present invention to provide a start-up method and apparatus for continuous casting of metal, in particular, melt drag casting of aluminum or aluminum alloys.

Another object of the invention is to improve casting of high purity aluminum alloys by establishing steady state casting conditions with a modified alloy composition prior to onset of the high purity alloy casting.

It is further object of the present invention to provide a start-up method and apparatus for continuous casting of molten metal into metal strip which permits casting a wide variety of alloys despite the existence of alloy properties that cause difficulties during casting start-up operation.

A still further object of the invention is to provide a start-up alloy for continuous casting of aluminum alloys having sufficient strength to be guided and coiled and having adequate release characteristics to avoid excessive or insufficient adherence to the casting wheel surface.

Other objects and advantages of the present invention will become apparent as the description thereof proceeds.

In satisfaction of the foregoing objects and advantages, the method of the present invention includes providing a molten metal having a first composition, providing a quantity of a start-up molten metal of a second composition, initially continuously casting the start-up molten metal on to a moving unitary chill surface to establish steady state casting, continuously casting the molten metal subsequent to the start-up molten metal being cast onto the moving chill surface and recovering a cast strip product comprising a portion of the start-up having the first composition with the balance being a cast strip product having the second composition.

An apparatus according to the invention for melt drag casting of molten metal comprises a source of molten metal, a tundish, and a rotating casting wheel having a unitary chilled casting surface. The source of molten metal having a first composition feeds the tundish for continuously melt drag casting the molten metal into a cast strip product. Also provided are means for initially casting a start-up alloy having a second composition onto the unitary chilled casting surface to establish steady state casting and subsequently casting the molten metal into said unitary chilled casting surface to produce a cast strip product comprising a portion having the first composition and the remaining balance comprising the second composition.

BRIEF DESCRIPTION OF THE DRAWINGS

Reference is now made to the drawings accompanying the application wherein.

DESCRIPTION OF THE PREFERRED EMBODIMENTS

The present invention, by providing a start-up method and apparatus for continuous casting of molten metal, solves the problem of starting up difficult-to-cast aluminum alloys in melt drag casting. In the method aspect of the invention, the target alloy to be cast can be modified by increasing or decreasing the alloying content thereof during the initial casting sequence. Alternatively, a highly alloyed target alloy can be diluted or alloyed down for initial melt drag casting. By providing a start-up alloy composition to initiate melt drag casting, improved consistency in the overall continuous casting operation is achieved. Consistent continuous cast start-ups result in improved yield of material and reduced operating cost by eliminating production shut downs and increased consistency during casting start-ups. Moreover, the casting apparatus can be designed to conform to the characteristics of the start-up alloy. For example, the guide rolls and other material handling components can be designed and configured to handle the same alloy during each casting start up. Thus, the casting apparatus setup does not have to be modified when alloys of varying composition and properties are cast.

Figure 2:
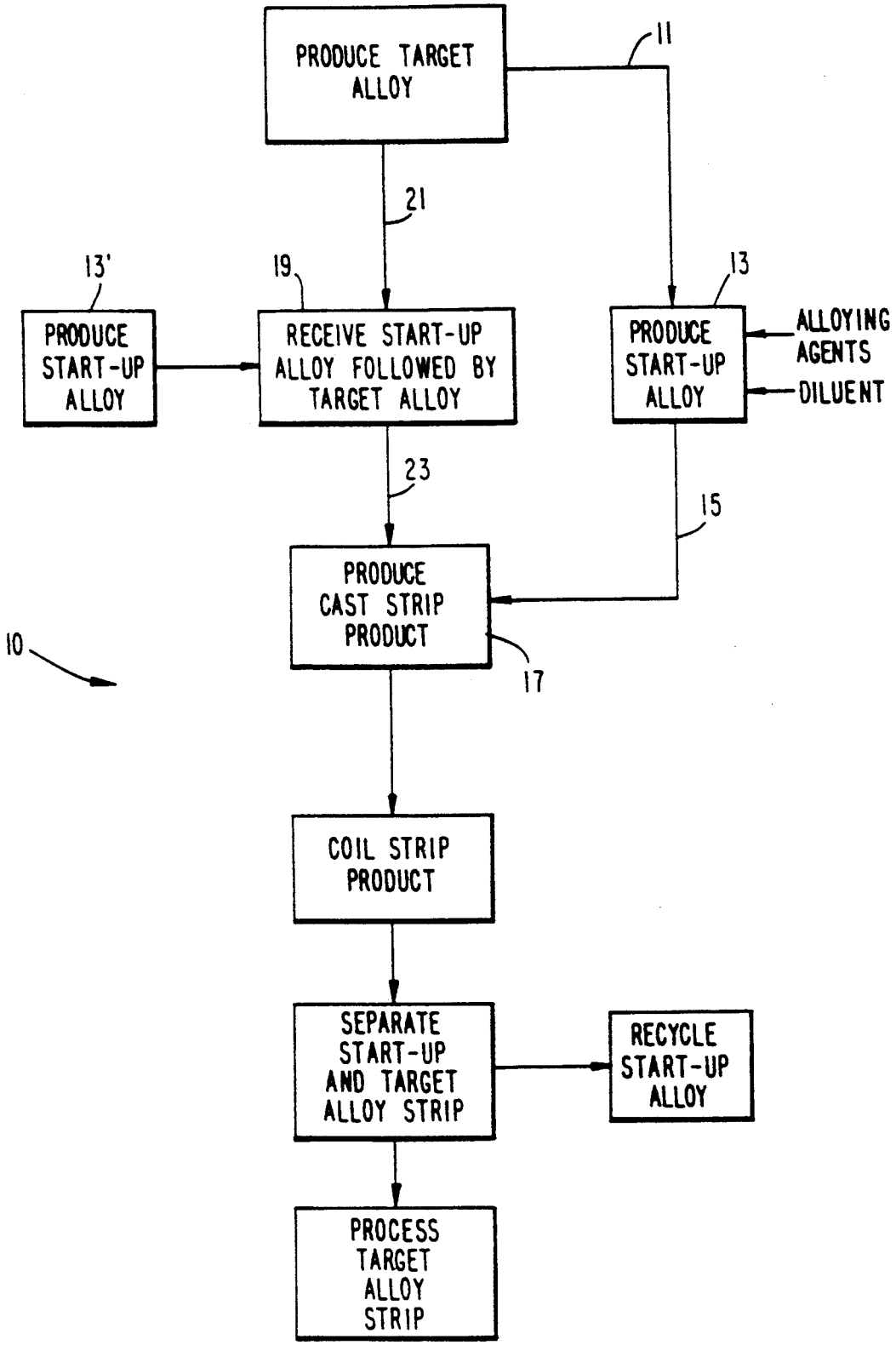
FIG. 2 is a flow diagram depicting process steps according to the present invention.

With reference now to FIG. 2, a flow diagram, generally designated by the reference numeral 10 outlines the process steps in the inventive process. Initially, a target alloy to be cast is produced according to conventional techniques. The target alloy is directed to an alloying container 13 via the route 11. In the alloying container 13, a charge of the target alloy is modified to produce the start-up alloy. To modify the target alloy, alloying agents or a diluent are added. If the target alloy is a high-purity type alloy, alloying agents are added to produce the start-up alloy. Alternatively, if the target alloy is a highly alloyed type aluminum alloy, a diluent such as molten aluminum may be added thereto to produce the start-up alloy. Once the selected amount of start-up alloy is produced, the start-up alloy is cast to produce a cast strip product as shown by the reference numeral 17. It should be understood that once the casting operation is initiated, the target alloy is continually flowed via route 11 through the alloying container 13 during casting. The amount of start-up alloy produced from the target alloy is calculated on the basis of the dilution rate of the start-up alloy composition resulting from merging of the target alloy flow 11 into the start-up alloy in the alloying container 13. A typical amount of start-up alloy averages about 3000 lbs. However, more or less start-up alloy may be utilized depending on the particular target alloy composition.

Once the cast strip product is produced, the strip product is accumulated or coiled on a mandrel. After the strip product has been coiled, the strip product may be uncoiled to separate the start-up and target alloy strips. The start-up alloy can be recycled while the target alloy strip is processed for further use.

In an alternative mode of the inventive method, the start-up alloy is formulated separate from the target alloy, see step 13'. The formulated start-up alloy may be prepared in a separate furnace or other holding vessel. Once the start-up alloy is prepared, it is charged to an intermediate vessel in the step designated by reference numeral 19. At the onset of casting, the target alloy flow, indicated by the reference numeral 21, is directed to the intermediate vessel. Simultaneously, the casting operation is initiated such that the start-up alloy flow, designated by the reference numeral 23 is directed into the tundish and onto the casting wheel. Again, the volume of start-up alloy is calculated to produce a steady state casting condition prior to dilution by the target alloy.

This mode of operation is especially adapted for target alloys exhibiting high strength and brittleness caused by a greater amount of alloying components. Rather than diluting the target alloy with solid or molten aluminum, e.g. alloying down, a start-up alloy of the desired composition can be charged to the intermediate vessel. The target alloy can then merge with the start-up alloy in the intermediate vessel during initiation of casting. In this mode, the casting sequence continues in the same manner as described above when formulating a start-up alloy using a portion of the target alloy.

When producing casting strips in wide widths, for example, greater than 33 inches, manhandling of the cast strip during casting start-up is difficult if not impossible due to the size and weight of the strip. Accordingly, strength and release characteristics of the start-up alloy are critical in starting up the casting process and achieving steady state casting to permit casting of a target alloy. The strength of a start-up alloy relates to its physical characteristics such as stiffness to permit feeding through the strip-handling equipment from the caster wheel to the rewind. The cast strip having the start-up alloy composition must also have sufficient tensile strength so that it is not pulled apart by feed rolls when it wraps around the rewind mandrel. Coupled with adequate stiffness and tensile strength, the strip must also possess sufficient flexibility to take general bends and direction changes without breaking.

Besides the appropriate physical characteristics, the start-up alloy composition must exhibit release characteristics in relationship to adherence to the casting wheel. The cast strip must release from the casting wheel so as not the wrap entirely around the wheel so as to burn the brushes and damage the tundish. On the other hand, the start-up alloy composition must not release too quickly causing possible casting operation shutdown by entanglement in the caster framework or other material handling components.

One example of an aluminum alloy that can be easily started up in a melt drag casting operation includes an aluminum alloy containing silicon in an amount between about 0.05 to 0.65 percent by weight, iron in an amount between about 0.12 to 0.75 percent by weight and copper in an amount between 0.01 and 0.25 percent by weight. Within this chemistry, some alloys on the high purity end are difficult to get off the casting wheel on start-up. In these instances, an intermediate alloy such as 0.06 percent by weight of silicon and 0.31 to 0.55 percent by weight of iron with a balance aluminum provides a consistent start-up operation.

Alternatively, a highly alloyed aluminum such as AA 5182 requires dilution when being used to formulate a start-up alloy. The amount of dilution depends on the specific alloying elements for a particular alloy and may vary accordingly.

Figure 3:
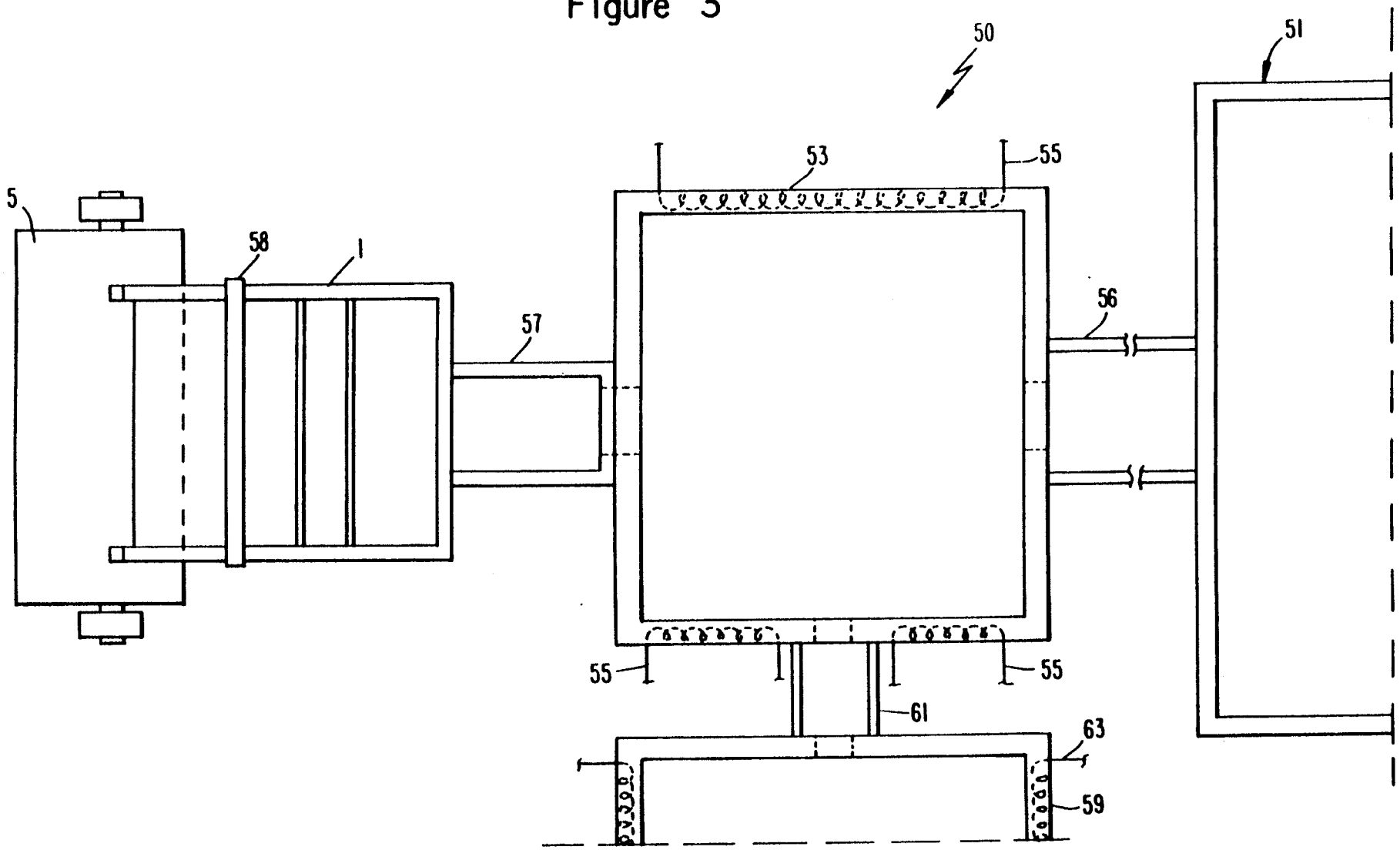
FIG. 3 shows a top view of a melt drag casting apparatus according to the present invention.

In practicing the inventive method, and with reference to FIG. 3, a start-up melt drag continuous casting apparatus generally is designated by the reference numeral 50. A furnace 51, which may be any known type such as a reverberatory or electric furnace, is in communication with an alloying container 53 via the trough 56. The alloying container 53 is heated by electric resistance heating 55. However, other known forms of heating may be utilized in maintaining a given temperature in the alloying vessel.

Figure 1:
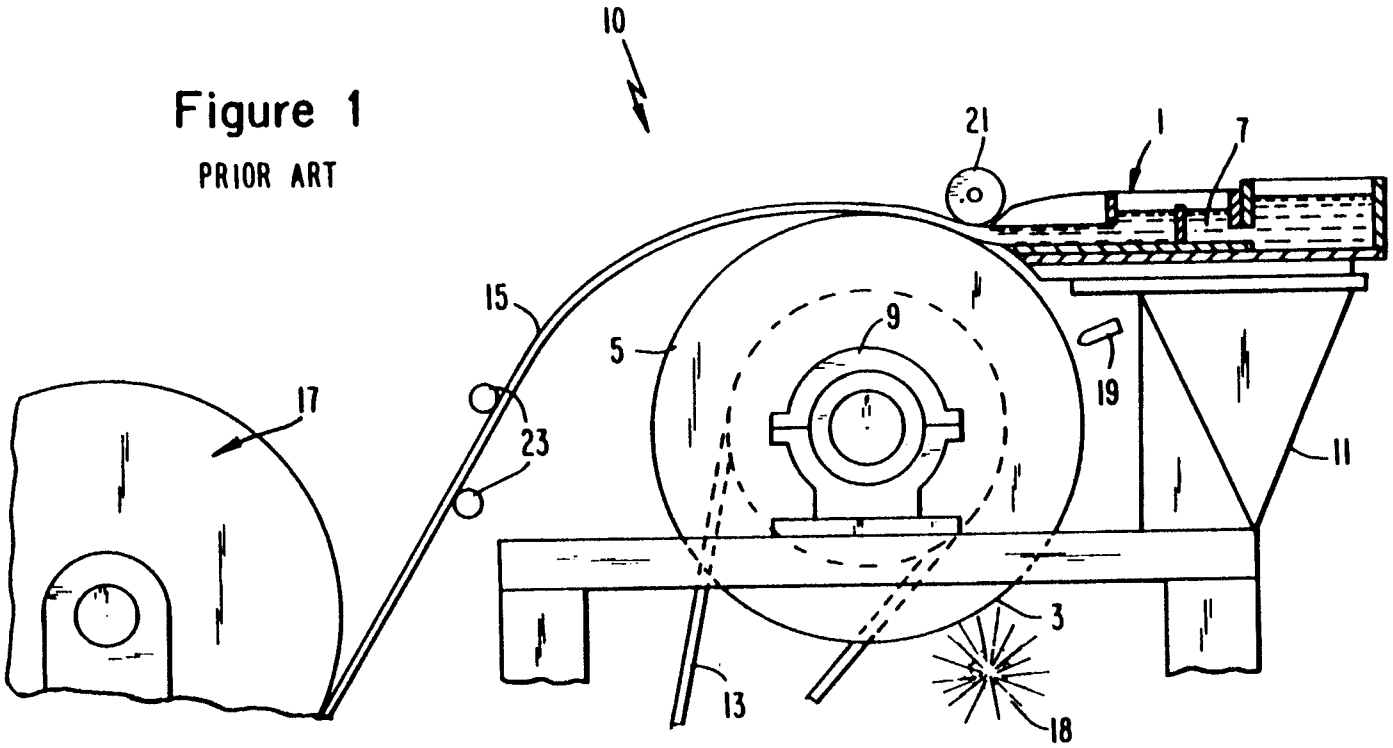
Figure 1 PRIOR ART
FIG. 1 is a schematic diagram of a prior art melt drag continuous casting apparatus.

The alloying vessel 53 is connected to the tundish 1 via trough 57. The tundish is equipped with a flow control gate 58 which controls onset of the continuous casting operation. The tundish and casting wheel 5 are similar to the prior art apparatus disclosed in FIG. 1 above.

It should be understood that the appropriate flow gates may be located between the various apparatus components for control over molten metal flow. For example, a control gate may be located between the alloying container 53 and the tundish 1.

The alloying container 53 can be used in the method described above wherein the target alloy is modified to form the start-up alloy.

In an alternative embodiment, a second alloying container 59 is connected to the alloying vessel container 53 via the trough 61. The second alloying container 59 is utilized to formulate a start-up alloy separate from the target alloy contained in the furnace 51. The formulated start-up alloy is fed via the trough 61 into the alloying container 53 prior to initiation of the continuous casting operation. The target alloy in the furnace 51 may be then be merged with the start-up alloy in the alloying container 59 during continuous casting.

The second alloying container 59 also includes electric resistance heating means 63 to maintain the start-up alloy at a predetermined temperature.

Although not illustrated in FIG. 3, the alloying agents or diluents may be added in a conventional form for the purposes of alloying up or alloying down to formulate a desired start-up alloy. Examples of typical alloying components forms include chips, briquettes, rocks or the like.

In the inventive method, it should be understood that the alloying up or alloying down may be performed in a filtering device such as a spinning nozzle inert gas filter. These types of filters are known in the art for removing impurities in aluminum or aluminum alloys.

Although the alloying containers are illustrated with square shapes, other configurations may be utilized in conjunction with the melt drag casting apparatus. Moreover, the alloying containers may be removable from between the melt drag casting wheel and tundish for maintenance purposes or the capability to feed the tundish directly from a furnace.

As such, an invention has been disclosed in terms of preferred embodiments which fulfill each and every one of the objects of the present invention as set forth hereinabove and provides a new and improved method and apparatus for start-up continuous casting of metal strip product.

Various changes, modifications and alterations from the teachings of the present may be contemplated by the those skilled in the art without departing from the intended spirit and scope thereof. Accordingly, it is intended that the present invention only be limited by the terms of the appended claims.

What is claimed is:

1. A method of continuous casting a molten metal comprising the steps of:

a) providing a molten metal having a first composition;

b) providing a quantity of a start-up molten metal of a second composition;

c) initially continuously casting said start-up molten metal on to a moving unitary chill surface to establish steady state casting;

d) continuously casting said molten metal subsequent to said start-up molten metal being cast onto said moving unitary chill surface; and e) recovering a cast strip product comprising a portion of said start-up molten metal having said first composition with the balance being a cast strip product having said second composition.

2. The method of claim 1 wherein said first composition is a high purity aluminum alloy and said second composition is an aluminum alloy having higher strength and less adherence to said moving chill surface than said high purity aluminum alloy.

3. The method of claim 1 wherein said second composition comprises:

about 0.05 to 0.65 weight percent of silicon;

about 0.12 to 0.75 weight percent of iron;

about 0.01 to 0.25 weight percent of copper; with the balance aluminum and inevitable impurities.

4. The method of claim 3 wherein said silicon is about 0.06 weight percent and said iron ranges between about 0.31 and 0.55 weight percent.

5. The method of claim 1 wherein said first composition is a high strength aluminum alloy and said second composition is an aluminum alloy having lower strength and higher elongation properties than said high strength aluminum alloy.

6. The method of claim 5 wherein said second composition comprises:

about 0.5 to 0.65 weight percent of silicon;

about 0.12 to 0.75 weight percent of iron;

about 0.01 to 0.25 weight percent of copper; with the balance aluminum and inevitable impurities.

7. The method of claim 6 wherein said silicon is about 0.06 weight percent and said iron ranges between about 0.31 and 0.55 weight percent.

8. The method of claim 1 wherein said quantity of said start-up molten metal is formed by adding alloying agents to said molten metal prior to step (c).

9. The method of claim 8 further comprising the steps of:

i) providing a start-up alloying container upstream of said unitary chill surface;

ii) charging said start-up alloy container with an amount of said molten metal; and iii) adding said alloying agents to said amount to obtain said quantity of start-up molten metal.

10. The method of claim 1 further comprising the steps of:

i) providing a start-up alloying container;

ii) charging said quantity of start-up molten metal into said start-up alloying container prior to step (c); and iii) charging said molten metal into said start-up alloying container prior to step (d).

* * * * *